US012447385B2

(12) United States Patent
Zorick

(10) Patent No.: US 12,447,385 B2
(45) Date of Patent: Oct. 21, 2025

(54) SPORT STICKS CONFIGURED TO SELECTIVELY DISASSEMBLE AND HAVING ADJUSTABLE STRENGTH AND FLEX CHARACTERISTICS

(71) Applicant: Broderick Zorick, Beaverton, OR (US)

(72) Inventor: Broderick Zorick, Beaverton, OR (US)

( * ) Notice: Subject to any disclaimer, the term of this patent is extended or adjusted under 35 U.S.C. 154(b) by 728 days.

(21) Appl. No.: 17/895,960

(22) Filed: Aug. 25, 2022

(65) Prior Publication Data

US 2022/0409970 A1 Dec. 29, 2022

Related U.S. Application Data

(63) Continuation-in-part of application No. 16/784,828, filed on Feb. 7, 2020, now abandoned.

(60) Provisional application No. 62/802,550, filed on Feb. 7, 2019.

(51) Int. Cl.

| | |
|---|---|
| ***A63B 60/22*** | (2015.01) |
| ***A63B 59/20*** | (2015.01) |
| ***A63B 59/70*** | (2015.01) |

(52) U.S. Cl.

CPC ..... *A63B 60/22* (2015.10); *A63B 59/20* (2015.10); *A63B 59/70* (2015.10); *A63B 2210/50* (2013.01)

(58) Field of Classification Search

CPC ..... A63B 60/22; A63B 59/20; A63B 59/70; A63B 2210/50; A63B 2102/14; A63B 2102/24; A63B 2225/09

See application file for complete search history.

(56) References Cited

U.S. PATENT DOCUMENTS

| | | | | |
|---|---|---|---|---|
| 5,029,847 | A * | 7/1991 | Ross | A63B 15/00 482/109 |
| 6,925,686 | B2 * | 8/2005 | Heathcock | B25G 1/04 16/427 |
| 10,898,406 | B2 * | 1/2021 | McAteer | A61H 3/068 |
| 2004/0116197 | A1 * | 6/2004 | Benson | A63B 53/00 473/316 |
| 2007/0259742 | A1 * | 11/2007 | McCauley | A63B 59/30 473/513 |
| 2012/0149486 | A1 * | 6/2012 | Wall, Jr. | A63B 53/10 473/296 |

(Continued)

FOREIGN PATENT DOCUMENTS

| | | | | |
|---|---|---|---|---|
| CA | 2936542 | A1 * | 1/2018 | A63B 69/36 |

*Primary Examiner* — Jeffrey S Vanderveen

(74) *Attorney, Agent, or Firm* — Mohr Intellectual Property Law Solutions, PC

(57) ABSTRACT

Sport sticks including a shaft, a plurality of different shaft connectors, and a head are disclosed. The shaft includes at least a first shaft section and a second shaft section. Each of the shaft connectors may couple the first shaft section to the second shaft section. The sport stick is configured to selectively convert between an assembled configuration and a disassembled configuration. In the assembled configuration, the first section, the first shaft connector, and the second section are coupled together. In the disassembled configuration, one or more of the first section, the first shaft connector, and the second section are selectively decoupled. Each one of the plurality of shaft connectors defines at least one of a unique strength characteristic of the sport stick and a unique flexibility characteristic of the sport stick when the sport stick is in the assembled configuration.

20 Claims, 12 Drawing Sheets

(56) References Cited

U.S. PATENT DOCUMENTS

| | | | | |
|---|---|---|---|---|
| 2018/0056153 | A1* | 3/2018 | Calandruccio ..... | A63B 59/20 |
| 2019/0299071 | A1* | 10/2019 | Giguere ..... | A63B 59/70 |

* cited by examiner

SPORT STICKS CONFIGURED TO SELECTIVELY DISASSEMBLE AND HAVING ADJUSTABLE STRENGTH AND FLEX CHARACTERISTICS

CROSS REFERENCE TO RELATED APPLICATIONS

This application is a Continuation in Part application of and claims priority to U.S. application Ser. No. 16/784,828, entitled "Sport Sticks Configured To Selectively Disassemble," filed on Feb. 7, 2020, which claims priority to U.S. Application, Ser. No. 62/802,550, filed on Feb. 7, 2019, which are both hereby incorporated by reference for all purposes.

BACKGROUND

The present disclosure relates generally to sport equipment. In particular, sport sticks configured to selectively disassemble are described.

Sport sticks are used in a variety of sports, such as ice hockey, field hockey, street hockey, lacrosse, tennis, badminton, racquetball, squash, baseball, softball, golf, and others. Sport sticks generally have a shaft and a head. A user holds and manipulates the stick with the shaft. The head is configured to interface with a ball, puck, or other play object, such as a shuttlecock.

A sport stick, such as a hockey stick, is an essential tool for playing various sports, such as ice hockey. One typically uses a sport stick to handle, pass, and shoot a ball, puck, or other play object during a game or match. When a player is not playing the sport, the player often needs to transport and store the sport stick until the next time he or she plays the sport, such as competing or practicing the sport.

Known sport sticks are not entirely satisfactory for the range of applications in which they are employed. For example, existing sport sticks are often large and awkwardly shaped, which makes them difficult to transport and store. The large size and awkward shape of conventional sport sticks also expose them and other objects to potential damage as they are transported and stored because the unwieldy sport sticks are prone to banging into objects.

The large size and awkward shape of existing sport sticks makes them difficult to store them in locations with other objects. Conventional sport sticks are subject to warping or losing structural integrity from other objects resting on the stick. Additionally, the large size and awkward shape may disincline one to bring the sport stick with him or her to different locations, which may reduce the likelihood that the individual will have the sport stick available for sporadic or random sport games.

In addition, conventional sport sticks lack means to adapt them to be suitable for different sports. Further, known sport sticks are not configured to allow different heads to be easily installed for different purposes, such as training or playing different positions.

Further, sport sticks are known to have different strength and/or flex characteristics. Thus, the player must acquire a plurality of different sport sticks, each with different strength and/or flex (flexibility) characteristics, from a vendor that provides such variety of manufactured sport sticks.

Thus, there exists a need for sport sticks that improve upon and advance the design of known sport sticks.

Examples of new and useful sport sticks relevant to the needs existing in the field are discussed below.

SUMMARY

The present disclosure is directed to sport sticks including a shaft, a shaft connector, and a head. The shaft includes at least a first shaft section and a second shaft section. The shaft connector couples the first shaft section to the second shaft section. The head is coupled to the shaft. The sport stick is configured to selectively convert between an assembled configuration and a disassembled configuration. In the assembled configuration, the first shaft section, the shaft connector, the second shaft section, and the head are coupled together. In the disassembled configuration, one or more of the first shaft section, the shaft connector, the second shaft section, and the head are selectively decoupled. A plurality of different shaft connectors are provided, each that provide different strength and/or flex characteristics to the assembled sport stick. The plurality of first shaft connectors may have different dimensions and/or be made of different materials to provide the different strength and/or flex characteristics to the assembled sport sticks. Some shafts may have more than two shaft sections and may use optionally use different shaft connectors to control strength and/or flexibility of the assembled sport stick.

DETAILED DESCRIPTION

Figure 1:
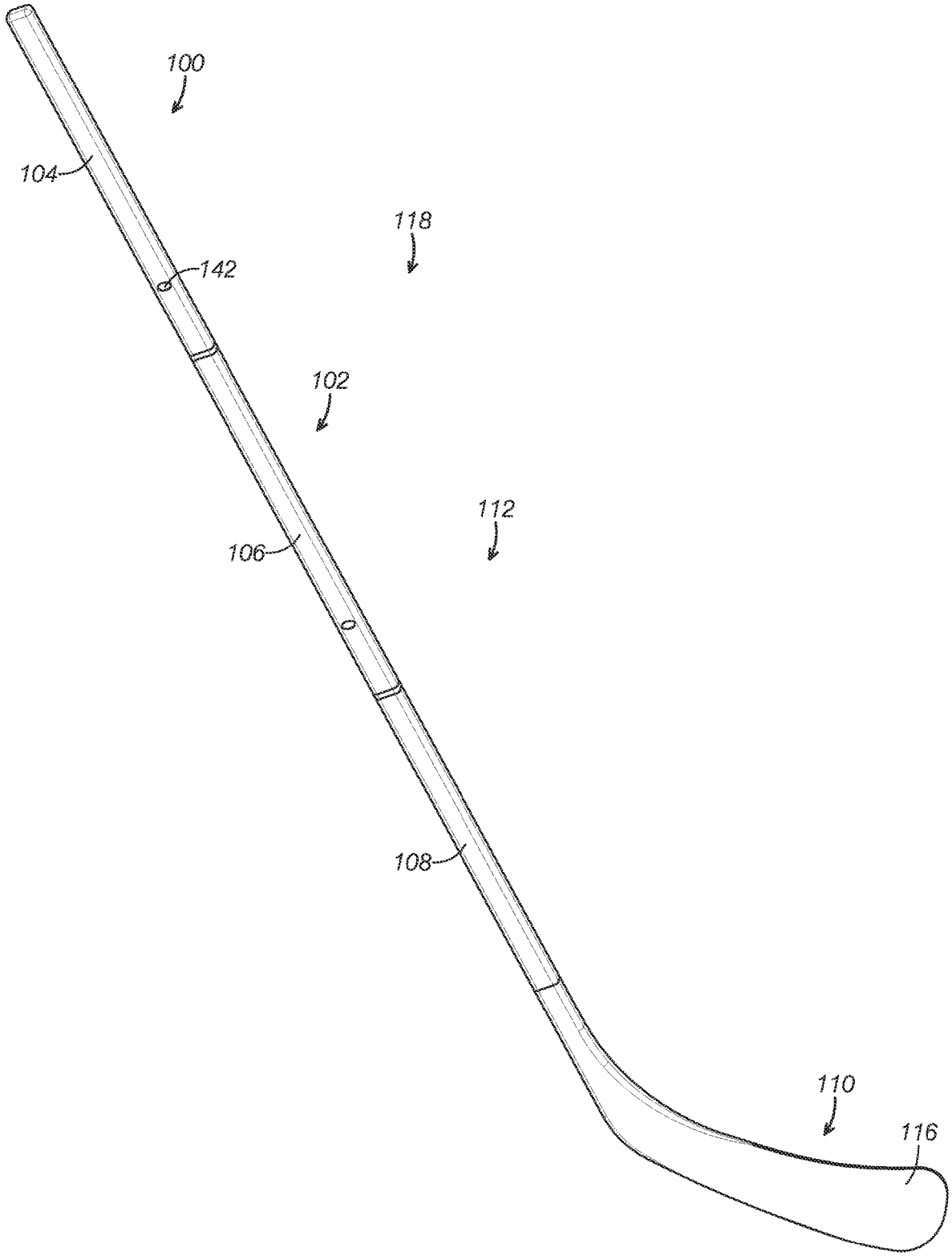
FIG. 1 is a perspective view of a first example of a sport stick in an assembled configuration and defining a hockey stick.

The disclosed sport sticks will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various sport sticks are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

"Strength" is a material's ability to withstand an applied load (shear and/or compressive force) without failure. The applied load generates internal stress forces and may result in material deformation. Material strength, as is known in the arts of mechanical engineering, can be measured or determined (computed) at a point where inelastic deformation occurs on a stress-strain curve.

"Flexibility" is the inverse of stiffness. Flexibility may be measured or determined, as is known in the arts of mechanical engineering, as:

$$q^m = f^m Q^m + q^{o\ m} \tag{1}$$

Sport Sticks Configured to Selectively Disassemble

With reference to the figures, sport sticks configured to selectively disassemble will now be described. The sport sticks discussed herein function to enable one to play a selected sport requiring a stick when the sport stick is in an assembled configuration. The sport sticks further function to selectively disassemble into a disassembled configuration when a user desires to transport or store the sport stick.

The reader will appreciate from the figures and description below that the presently disclosed sport sticks address many of the shortcomings of conventional sport sticks. For example, the sports sticks described herein can be disassembled into a relatively small and convenient size for easy transport and storage unlike existing sport sticks, which are often, fixed in a large and awkward shape. In addition, the sport sticks disclosed in this document may be readily adapted to be suitable for different sports. Further, the sport sticks discussed herein are configured to allow different heads to be easily installed for different purposes, such as training or playing different positions.

Sport Stick Embodiment One

With reference to FIGS. 1-3, 7, and 8, a first example of a sport stick, sport stick 100, will now be described. Sport stick 100 includes a shaft 102, a first shaft connector 108, a second shaft connector 126, a head 110, and an elongate tension bearing member 128. In the sport stick 100 embodiment, shaft 102 includes a first section 104, a second section 106, and a third section 124.

Figure 2:
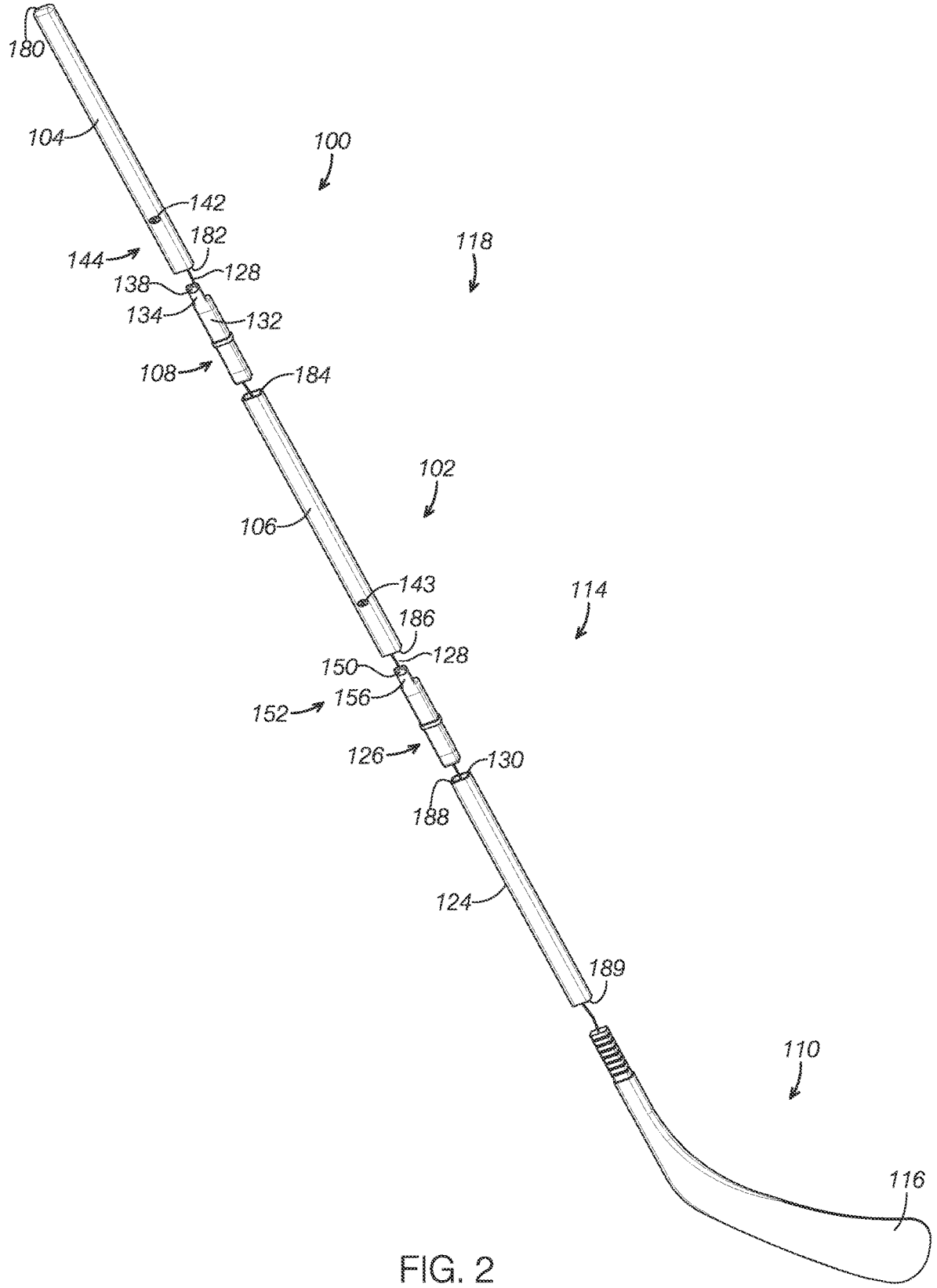
FIG. 2 is a perspective view of the sport stick shown in FIG. 1 in a disassembled configuration.

As can be seen in FIGS. 1 and 2, sport stick 100 is configured to selectively convert between an assembled configuration 112, shown in FIG. 1, and a disassembled configuration 114, shown in FIG. 2. In assembled configuration 112, first section 104, first shaft connector 108, second section 106, second shaft connector 126, and third section 124 are coupled together and head 110 is coupled to shaft 102. In disassembled configuration 114, first section 104, first shaft connector 108, second section 106, second shaft connector 126, third section 124, and head 110 are selectively decoupled.

In some examples, the sport stick does not include one or more features included in sport stick 100. For example, some sport stick examples do not include an elongate tension bearing member. Further, in some examples, the shaft includes fewer sections, such as two sections or a single section. In other examples, the shaft includes more than three sections, such as four sections or five or more sections.

In some examples, the sport stick does not include shaft connectors distinct from sections of the shaft. In examples without shaft connectors, the sections of the shaft may be configured to selectively couple and decouple to each other directly, such as via friction fits.

Shaft

Figure 7:
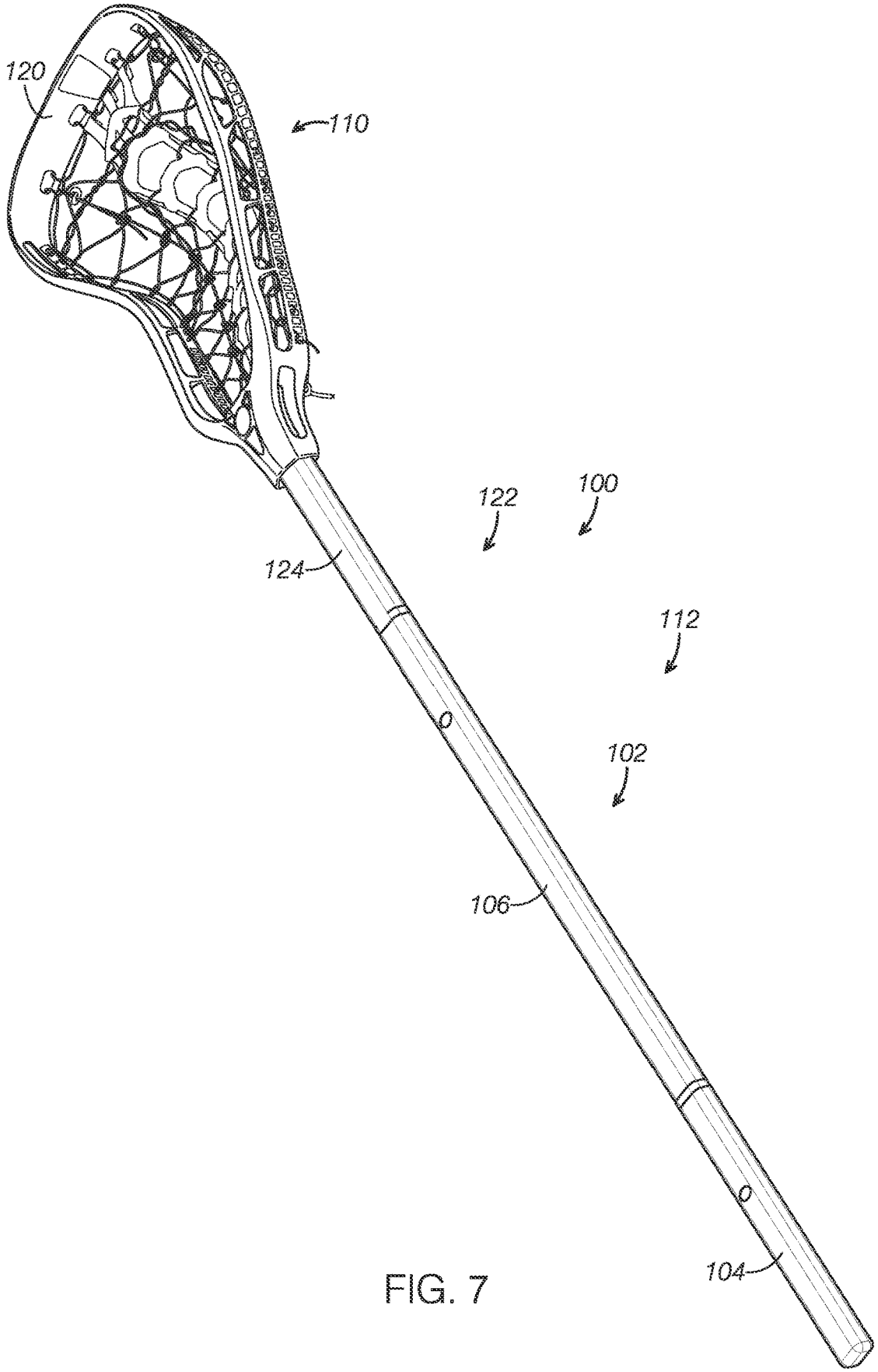
FIG. 7 is a perspective view of the sport stick shown in FIG. 1 with a lacrosse head coupled to the shaft to define a lacrosse stick.
Figure 8:
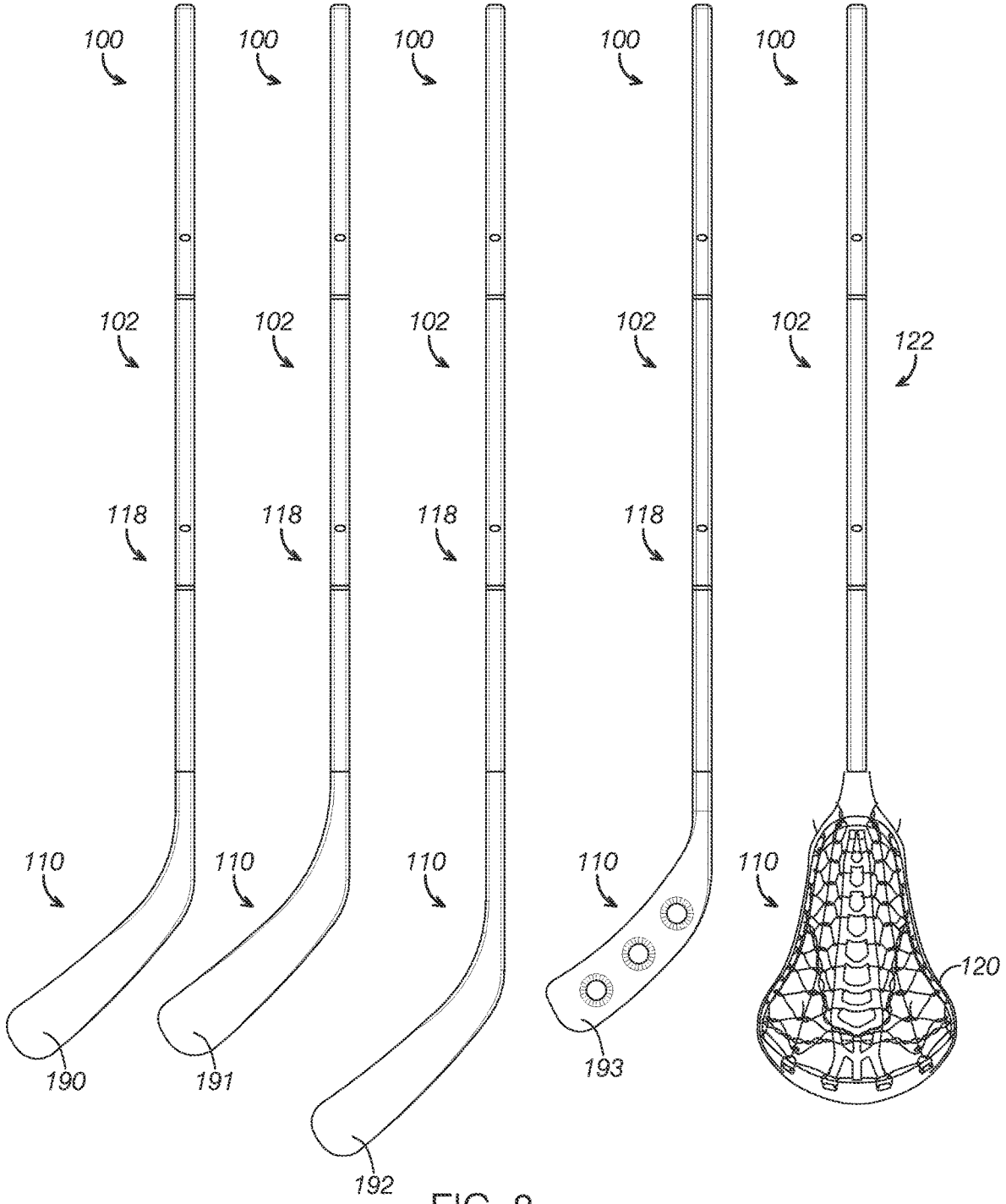
FIG. 8 is a view of the shaft shown in FIG. 1 with a collection of different heads configured to couple to the shaft, one head being a hockey blade with a first size and a first weight, one head being a hockey blade of the first size and a second, heavier weight, one head being a hockey blade with a second, larger size, one head being a street hockey blade, and one head being a lacrosse head.

Shaft 102 functions to support head 110 and to enable a user to hold and manipulate sport stick 100 when playing a sport. Further, shaft 102 functions to selectively disassemble to make transporting and storing sport stick 100 more convenient. As shown in FIGS. 1, 7, and 8, shaft 102 also functions to couple with different types of heads interchangeably As can be seen in FIGS. 1-3, 7, and 8, shaft 102 includes first section 104, second section 106, and third section 124. In some examples, the shaft includes fewer sections, such as two sections or a single section. In other examples, the shaft includes more than three sections, such as four sections or five or more sections.

An increased number of sections and shaft connectors for the shaft may increase the sport stick's durability. In a typical sport stick comprised of a unitary shaft, localized points on the shaft are often subject to increased pressure when the stick flexes as it is used to play a sport and are prone to structure failure, such as bending, cracking, or otherwise breaking. In the sport stick examples discussed herein, the shaft connectors function to structurally reinforce the sport stick and to disperse the forces on the shaft as it flexes to multiple points along the sport stick. The dispersed force may reduce the likelihood that the sport stick may bend or break. The sport stick may be configured to have shaft connectors disposed at locations where the shaft is typically subject to increased force during normal use to reinforce the shaft.

In the sport stick 100 example, first section 104 extends from a first proximal end 180 to a second distal end 182. Second section 106 extends from a third proximal end 184 to a fourth distal end 186. Third section 124 extends from a fifth proximal end 188 to a sixth distal end 189.

In configurations where the sport stick defines a hockey stick, such as shown in FIG. 1, or a lacrosse stick, such as shown in FIG. 7, a user will typically hold the stick at the first section with one hand and at the second section with another hand. However, the user will also often move his or her hand placement throughout a game to hold the stick in a variety of positions along the shaft. In the present example, head 110 couples to third section 124 at sixth end 189.

The shaft may be made of metal, a metal alloy, plastic, polyurethane, or any other currently known or later developed material that may withstand the forces applied to the sport stick when it is used to play a sport. In shaft 102, first section 104, second section 106, and third section 124 are made of the same material. In other examples, one or more sections are made of different materials.

Different materials may be selected to imbue the sport stick with different strength and play attributes. For example, certain materials for the shaft sections may be selected to reinforce the strength and rigidity of the sport stick while other materials may be selected to increase the flexibility of the sport stick. Additionally or alternatively, certain materials for the shaft sections may be selected to increase or decrease the weight of the stick.

In the example shown in FIGS. 1-3, 7, and 8, first section 104, second section 106, and third section 124 are rectangular tubes. First section 104, second section 106, and third section 124 (along with first shaft connector 108 and second shaft connector 126) each define a longitudinal bore 130 through which elongate tension bearing member 128 extends. In some examples, the second end of the first section is tapered and the third end of the second section is flared so that the first section and the second section may be connected without the first shaft connector.

As shown in FIGS. 1 and 2, first section 104 defines a first hole 142 and second section 106 defines a second hole 143. As discussed further below, first hole 142 is complementarily configured with a first projection 138 of first shaft connector 108 to receive first projection 138. Second hole 143 is complementarily configured with a second projection 139 of second shaft connector 126 to receive second projection 139.

Shaft Connectors

The shaft connectors function to selectively couple sections of the shaft. Additionally or alternatively, the shaft connectors function to strengthen the shaft and distribute forces along the shaft. In some examples, the shaft connectors function to orient the sections of the shaft into a desired relationship and to maintain a desired spacing between sections.

In the example shown in FIGS. 1-3, 7, and 8, sport stick 100 includes two shaft connectors, first shaft connector 108 and second shaft connector 126 (interchangeably referred to herein as connectors). In other examples, the sport stick includes a single shaft connector. In different examples, the sport stick includes three or more shaft connectors. The sport stick may include a plurality of shaft connectors in some examples.

In certain examples, the sport stick does not include a shaft connector. In some examples where the sport stick does not include a shaft connector, the sport stick includes a unitary shaft and the head couples to the shaft. In other examples where the sport stick does not include a shaft connector, the shaft includes distinct sections that couple to each other without a shaft connector. For example, one end of a first section may be tapered and a corresponding end of a second section may be flared so that the first section and the second section may be directly connected without a shaft connector. In some examples, the sections are telescopically configured. In telescopic configurations, the sections are configured to nest within each other in the disassembled configuration and to telescope out from each other in the assembled configuration.

In the example shown in FIGS. 1-3, 7, and 8, first shaft connector 108 couples first section 104 to second section 106. Second shaft connector 126 couples second section 106 to third section 124. More specifically, first shaft connector 108 is coupled to second end 182 of first section 104 and to third end 184 of second section 106 to couple first section 104 to second section 106. Second shaft connector 126 is coupled to fourth end 186 of second section 106 and to fifth end 188 of third section 124 to couple second section 106 to third section 124.

First shaft connector 108 is complementarily configured with first section 104 and with second section 106 to couple to first section 104 and to second section 106 via a friction fit. Further, second shaft connector 126 is complementarily configured with second section 106 and with third section 124 to couple to second section 106 and to third section 124 via a friction fit.

In other examples, the shaft connectors couple to sections of the shaft through additional or alternative means than a friction fit. For example, the first shaft connector may include threads that are integrated into both the first section and the second section. To connect or disconnect the first section and the second section, the individual may screw or unscrew, respectively, the first section from the second section. In another example, the first shaft connector may be a coupling, a flange, a nipple, a screw, a compression fitting, and so forth.

In the example shown in FIGS. 1-3, 7, and 8, first shaft connector 108 includes a body 132, a first tab 134, and a ledge 172.

Figure 3:
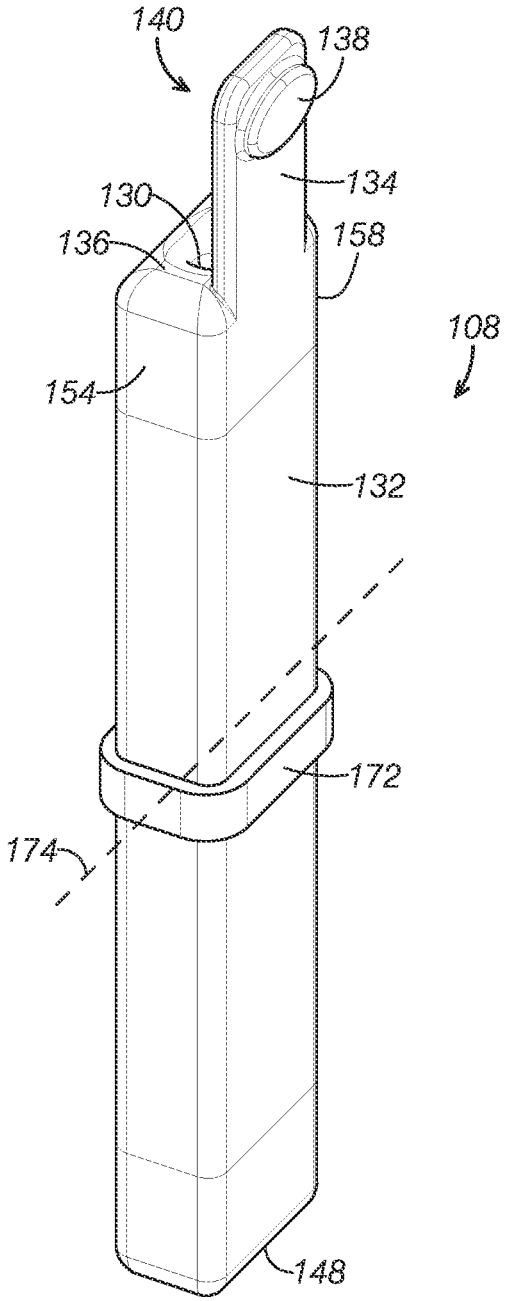
FIG. 3 is a perspective view of a shaft connector embodiment.

Body 132 extends longitudinally between a first longitudinal end 136 and a second longitudinal end 148 opposite first longitudinal end 136. Body 132 defines a longitudinal midline 174 midway between first longitudinal end 136 and second longitudinal end 148. As can be seen in FIG. 3, body 132 also extends between a first lateral end 154 and a second lateral end 158 opposite first lateral end 154.

As shown in FIG. 3, first tab 134 extends from body 132 at first longitudinal end 136. First tab 134 includes a first projection 138 to define a first detent 140. First hole 142 of first section 104 and first detent 140 collectively define a first detent mechanism 144 to selectively couple first section 104 to first shaft connector 108. In similar fashion, second hole 143 of second section 106 and second projection 139 of second shaft connector 126 cooperate to selectively couple second section 106 to second shaft connector 126.

Ledge 172 extends from body 132. In the present example, ledge 172 extends all the way around the outer boundary of body 132, but, in other examples, does not extend fully around the body. As shown in FIG. 3, ledge 172 is disposed at a longitudinal midline 174 of body 132. In other examples, the ledge is disposed at other longitudinal positions on the body not corresponding to the longitudinal midline.

As shown in FIGS. 1 and 2, body 132 and ledge 172 are complementarily configured with first section 104 such that, in assembled configuration 112, body 132 inserts within first section 104 and first section 104 abuts ledge 172. In the example shown in FIGS. 1-3, 7, and 8, body 132 and ledge 172 are also complementarily configured with second section 106 such that, in assembled configuration 112, body 132 inserts within second section 106 and second section 106 abuts ledge 172

Figure 4:
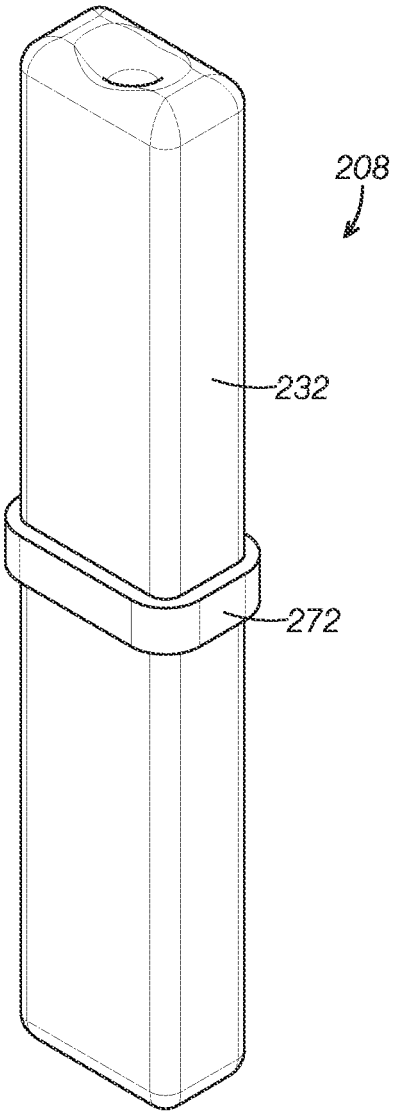
FIG. 4 is a perspective view of another shaft connector embodiment.
Figure 5:
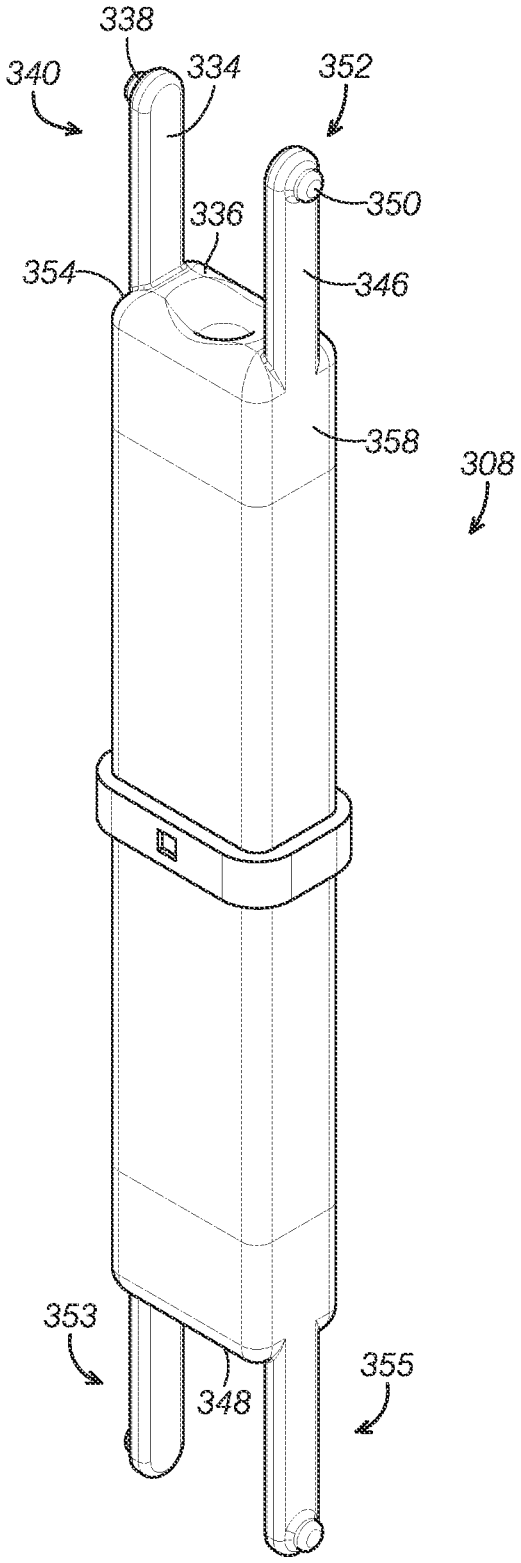
FIG. 5 is a perspective view of another shaft connector embodiment.
Figure 6:
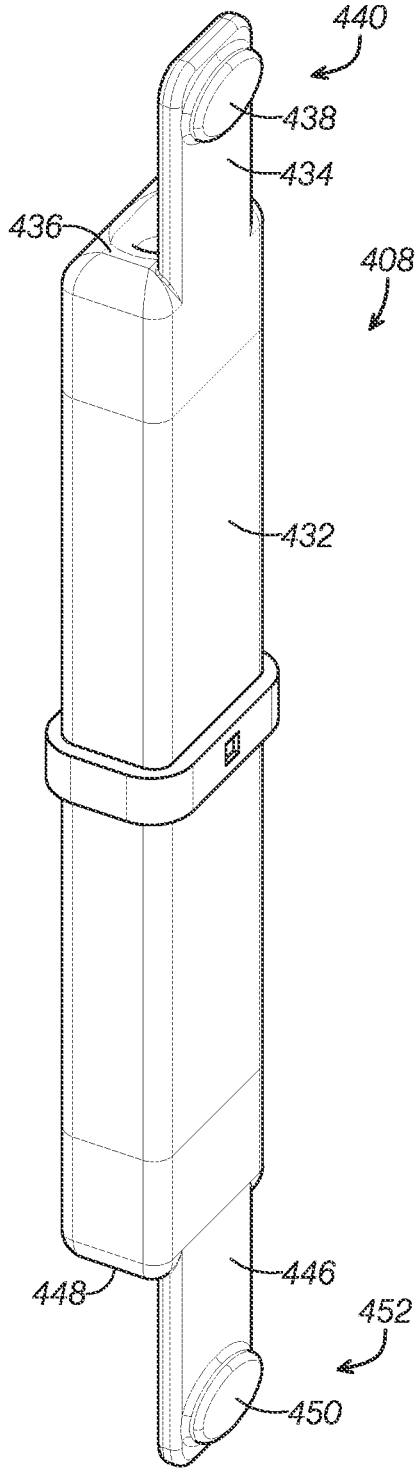
FIG. 6 is a perspective view of another shaft connector embodiment.

In other shaft connector examples, such as shown in FIGS. 4-6, the shaft connector is configured differently than shaft connector 108. For example, in FIG. 4, a shaft connector 208 includes a body 232 and a ledge 272 without a tab.

In FIG. 5, a shaft connector 308 includes a first tab 334 and a second tab 346. First tab 334 extends from body 332 at first lateral end 354 (interchangeably referred to herein as a proximal body end). First tab 334 includes a first projection 338 to define a first detent 340. Second tab 346 extends from body 332 at first longitudinal end 336 and at a second lateral end 358. Second tab 346 includes a second projection 350 to define a second detent 352. The reader can see in FIG. 5 that shaft connector 308 further includes a third detent 353 and a fourth detent 355 extending from second longitudinal end 348 (interchangeably referred to herein as a distal body end).

In FIG. 6, a shaft connector 408 includes a first tab 434 and a second tab 446. First tab 434 extends from body 432 at first longitudinal end 436. First tab 434 includes a first projection 438 defining a first detent 440. Second tab 446 extends from body 432 at a second longitudinal end 448 opposite first longitudinal end 436. Second tab 446 includes a second projection 450 defining a second detent 452.

The shaft connectors described herein may be made of metal, a metal alloy, plastic, polyurethane, or any other currently known or later developed material that may withstand the forces applied to the sport stick when it is used to play a sport. In the example shown in FIGS. 1-3, 7 and 8, first shaft connector 108 and second shaft connector 126 are made of the same material. In other examples, the shaft connectors are made of different materials.

Different materials may be selected to imbue the sport stick with different strength and play attributes. For example, certain materials for the shaft connectors may be selected to reinforce the strength and rigidity of the sport stick while other materials may be selected to increase the flexibility of the sport stick. Additionally or alternatively, certain materials for the shaft connectors may be selected to increase or decrease the weight of the stick.

The size and shape of the shaft connectors may vary from the examples depicted in the figures. For example, the shaft connector length may be shorter than shown in the figures or may be longer than shown. Longer length shaft connectors may provide additional strength and rigidity to the shaft whereas shorter length shaft connectors may increase the flexibility of the shaft. In some examples, the shaft connector does not include a ledge. In examples without a distinct ledge, the shaft connector may taper longitudinally from the midline to each longitudinal end of the body of the shaft connector such that the shaft sections cannot extend past the midline when coupling to the shaft connector via a friction fit.

Elongate Tension Bearing Member

Elongate tension bearing member 128 functions to maintain the components of sport stick 100 in close proximity when sport stick 100 is in disassembled configuration 114. In examples that do not include an elongate tension bearing member, the components of the sport stick are free to be separated in the disassembled configuration. The freedom to separate the components may be desirable in some contexts, but keeping the components close to each other with elongate tension bearing member may be also desirable. Keeping the components close together may be desirable to avoid misplacing a component and to more easily manage and organize the components in the disassembled configuration.

As shown in FIG. 2, a proximal end of the elongate tension bearing member 128 is coupled to first section 104 and a distal end of the elongate tension bearing member 128 is coupled to head 110. Elongate tension bearing member 128 extends through longitudinal bore 130 defined in each of first section 104, second section 106, third section 124, first shaft connector 108, and second shaft connector 126.

In the present example, elongate tension bearing member 128 is not coupled to second section 106, third section 124, first shaft connector 108, and second shaft connector 126. Instead, second section 106, third section 124, first shaft connector 108, and second shaft connector 126 are free to move relative to elongate tension bearing member 128, which extends through longitudinal bore 130 defined in their respective bodies. In other examples, the elongate tension bearing member is secured to one or more of the second section, the third section, the first shaft connector, and the second shaft connector to fix the position of those components relative to the elongate tension bearing member.

In the example shown in FIGS. 1-3, 7, and 8, elongate tension bearing member 128 is elastic and returns to its original length when tension is removed. In the present example, elongate tension bearing member is a shock cord. In other examples, the elongate tension bearing member is a bungie cord or other elastic member. In some examples, the elongate tension bearing member is not elastic. In examples where the elongate tension bearing member is not elastic, it may be a rope, a cord, a string, or a strap.

Elongate tension bearing member 128 has a length sufficient to hold the multiple sections in a tight engagement with each other, as shown in FIG. 1; yet is stretchable enough to permit the sections to be disassembled, as shown in FIG. 2, and articulated into a compact bundle.

Head

The head functions to interface with a ball, puck, shuttle cock, or other play object as part of playing a given sport. Further, the head functions to define the type of sport the sport stick is configured to play, such as a hockey stick, a lacrosse stick, or a tennis racquet.

In the present example, as shown in FIG. 8, sport stick 100 is configured to selectively utilize a variety of different heads interchangeably. Sport stick 100 utilizes a variety of different heads by shaft 102 being configured to selectively couple with a variety of different heads. In the example shown in FIGS. 1, 7 and 8, head 110 is coupled to third section 124 of shaft 102 at sixth end 189.

As shown in FIG. 8, head 110 may be a first ice hockey blade 190, a second ice hockey blade 191, a third ice hockey blade 192, a street hockey blade 193, or a lacrosse head 120. In other examples, the head is a tennis racquet head, a racquetball racquet head, a badminton racquet head, or a squash racquet head. Additionally or alternatively, the head may be a head of a baseball bat or a golf club head.

In FIG. 8, sport stick 100 defines a hockey stick 118 in the examples where head 110 is a first ice hockey blade 190, a second ice hockey blade 191, a third ice hockey blade 192, and a street hockey blade 193. Sport stick 100 defines a lacrosse stick 122 in the examples shown in FIGS. 7 and 8 where head 110 is a lacrosse head 122. In examples where the head is a racquet head, the sport stick defines a racquet, such as a tennis racquet, a racquetball racquet, a badminton racquet, or a squash racquet. In examples where the head is a head of a baseball bat, the sport stick defines a baseball bat. In examples where the head is a golf club head, the sport stick defines a golf club.

First ice hockey blade 190 and second ice hockey blade 191 are the same size, but have different mass or weight. The different mass or weight may be useful for training purposes. For example, a hockey player may wish to practice with second ice hockey blade 191, which is heavier than first ice hockey blade 190, to increase his or her strength with regard to maneuvering sport stick 100. When playing a competitive game, the hockey player may wish to replace second ice hockey blade 191 with first ice hockey blade 190 to increase the speed at which he or she swings sport stick 100 and maneuvers it during game play. By having second ice hockey blade 191 be the same size as first ice hockey blade 190, the hockey player will avoid getting used to a different sized blade than he or she will use in a game.

In FIG. 8, third ice hockey blade 192 is a larger size than first ice hockey blade 190 and second ice hockey blade 191. The larger size of third ice hockey blade 192 may be useful for different ice hockey positions, such as defensive positions or the position of goalie. The larger size may also be more suitable for players of different ages and skill levels.

With continued reference to FIG. 8, the different head options are shown coupled to separate shafts for clarity, but the reader should understand that the shafts are identical and a single shaft could be depicted instead of multiple shafts. Expressed another way, each head depicted in FIG. 8 may interchangeably couple to the same shaft in place of another head.

Continuation in Part Disclosure

Shaft connectors, as described herein, are identified in the various figures using the reference numeral x08, depending upon the illustrated shaft connector embodiment. For example, shaft connector 108 is illustrated in FIG. 1 is a first shaft connector embodiment, and shaft connector 208 illustrated in FIG. 4 is a second shaft connector embodiment. Shaft connector features described herein that are used to control shaft strength and/or shaft flexibility are equally applicable to all shaft connector embodiments. The particular amount of shaft strength and/or shaft flexibility control provided by a shaft connector can be determined (computed) based known dimensions of the shaft connector, or may be measured by testing a physical embodiment of the shaft connector. All such shaft connector features used in different shaft connector embodiments are intended to be included within the scope of this disclosure and to be protected by the accompanying claims. The amount of strength provided by a shaft connector to a shaft may be calculated and/or measured for the various shaft connector embodiments. Additionally, or alternatively, the amount of flexibility provided by a shaft connector to a shaft may be calculated and/or measured for the various shaft connector embodiments.

Figure 9A:
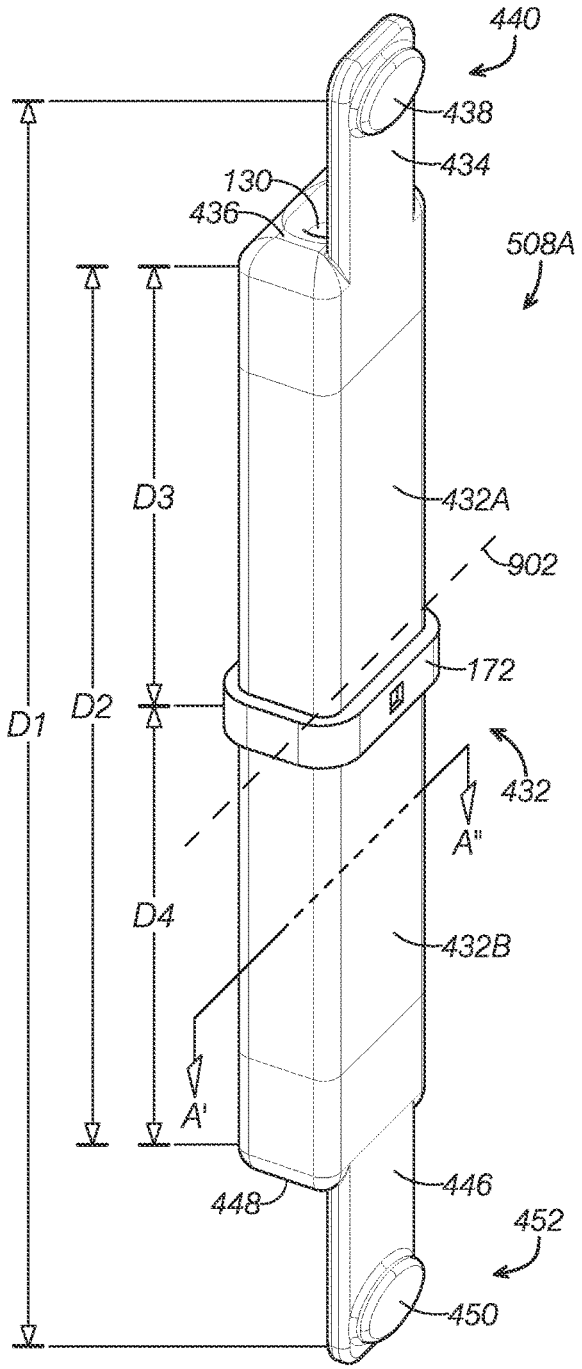
FIG. 9A is an example shaft connector embodiment with a predefined length dimension.

FIG. 9A is an example shaft connector 432 embodiment with a first predefined length dimension D1 that defines a total shaft connector length of the shaft connector 508A as measured from the center of the first projection 438 of the first detent 440 to the center of the second projection 450 of the second detent 452. Accordingly, when distal end of a first shaft section is coupled to a proximal end of a second shaft section using any shaft connector embodiment, the distance between the center of the first projection 438 of the first detent 440 to the center of the second projection 450 corresponds to the holes disposed in the assembled shaft such that when the shaft is assembled, the tabs 438, 450 protrude through the corresponding shaft holes to lock the shaft section together.

To couple the shaft connector 508A to a shaft, the user slidably inserts the detent 440, 452 into the bore of the shaft. As the end of the shaft reaches the ledge 172, the tabs 438, 450 align with and then engage with the corresponding shaft hole. The flexibility of the tab 434, 446 then urges the aligned tab 438, 450 through the corresponding tab holes (see FIGS. 1 and 2, for example). To decouple shaft sections, the user simply presses the tabs 438, 450 inward so that the shaft section can be slidably removed from the shaft connector embodiment. The total shaft connector length D1 may be defined in different manners. However, regardless of the features of the shaft connector embodiment that are used to define the total shaft connector length D1, the tabs 438, 450 will be urged through the shaft holes to secure the shaft connector embodiment to the shaft when the shaft connector embodiment is used to couple two shaft sections together.

The body 432 of the shaft connector 508A is defined by a predefined body length D2 that extends from the first (proximal) longitudinal end 436 to the second (distal) longitudinal end 448. Further, the body length D2 of the body 432 can be defined by proximal body portion 432A defined by a predefined proximal body length D3 and a distal body portion 432B defined by a predefined distal body length D4. The proximal body length D3 extends from the midline 902 of the ledge 172 to the first longitudinal end 436. The distal body length D4 extends from the midline 902 of the ledge 172 to the second longitudinal end 448. One skilled in the art appreciates that in embodiments where the proximal body length D3 and the distal body length D4 are the same, the midline 902 corresponds to the midline 174 of FIG. 3. In embodiments that do not employ the ledge 172, the midline 902 that defines the proximal length D3 and the distal D4 corresponds to a distance that is midway (halfway) between the tabs 438, 450.

In embodiments that employ the elongate tension bearing member 128, the longitudinal bore 130 extends through the length of the body 432 of the various shaft connectors that are used to control shaft strength and/or shaft flexibility.

Figure 9B:
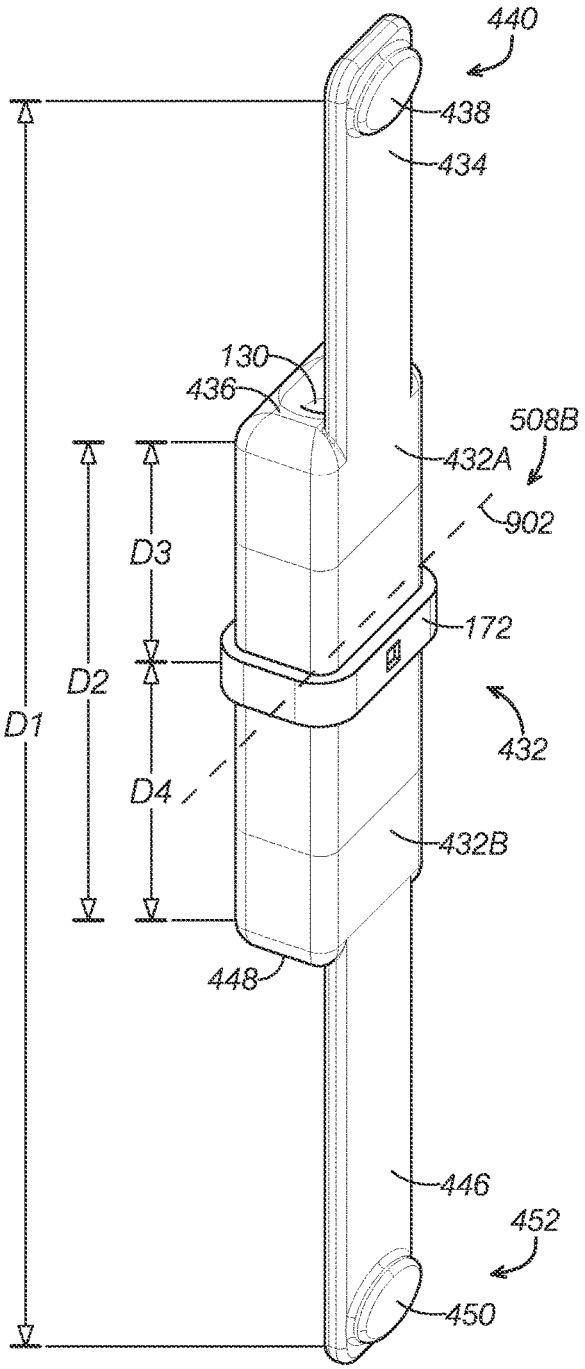
FIG. 9B is another example shaft connector that has a different predefined length dimension than the shaft connector embodiment illustrated in FIG. 9A.

FIG. 9B is another example shaft connector 508B that has a shorter predefined body length D2 than the shaft connector 508A embodiment illustrated in FIG. 9A. The shaft connector 508B may also be defined by a proximal body portion 432A defined by a shorter predefined proximal body length D3 and by a distal body portion 432B defined by a shorter predefined distal body length D4 (as compared to the corresponding lengths D2, D3 of the shaft connector 508A of FIG. 9A).

Comparing dimension characteristics (namely, the body length D2, proximal body length D3, and distal body length D4) of the shaft connectors 508A and 508B, one skilled in the art appreciates that the shaft connector 508A will provide more strength to the coupled shaft sections than the shaft connector 508B because of the longer length of the body 432 of the shaft connector 508A (defined by body length D2, proximal body length D3, and distal body length D4). Conversely, one skilled in the art appreciates that the shorter body 432 of the shaft connector 508B (defined by length D2, proximal body length D3, and distal body length D4) will provide less strength to the coupled shaft sections than the body 432 of the shaft connector 508A.

Further, one skilled in the art appreciates that the shaft connector 508B will provide more flexibility to the coupled shaft sections than the shaft connector 508A because of the shorter length of the body 432 of the shaft connector 508B (defined by body length D2, proximal body length D3, and distal body length D4). Conversely, one skilled in the art appreciates that the longer body 432 of the shaft connector 508A (defined by length D2, proximal body length D3, and distal body length D4) will provide less flexibility to the coupled shaft sections than the body 432 of the shaft connector 508B.

Figure 9C:
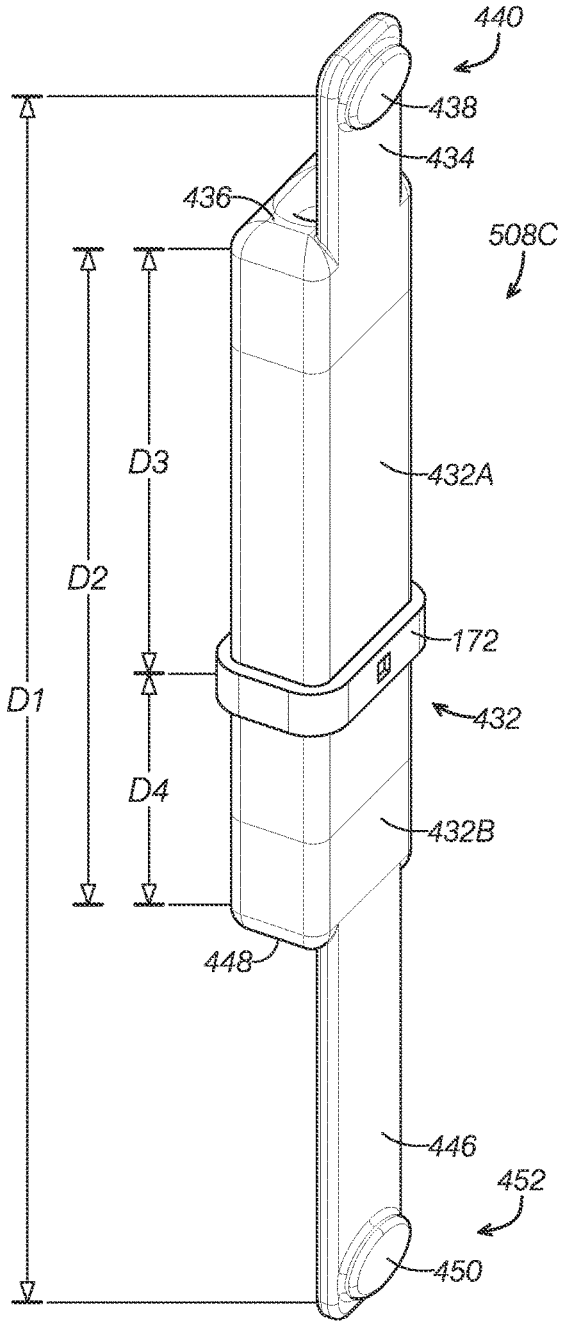
FIG. 9C is another example shaft connector that has a different predefined length dimension than the shaft connector embodiments illustrated in FIGS. 9A and 9B.

FIG. 9C is another example shaft connector that has different predefined length dimensions than the shaft connector embodiments illustrated in FIGS. 9A and 9B. Here, shaft connector 508C has a proximal body portion 432A defined by a predefined proximal body length D3 that is greater than (different than) its predefined distal body length D4 of the distal body portion 432B. Accordingly, when the shaft is assembled using the shaft connector 508C, the longer proximal body length D3 provides a greater strength and a higher resistance to flexibility to the distal end of the shaft section than the shorter distal body length D4 provides to the distal end of the adjacent shaft section. Here, the proximal body portion with the predefined proximal body length D3 and the distal body portion with the predefined distal body length D4 cooperatively define at least one of a unique strength characteristic of the sport stick 100 and a unique flexibility characteristic of the sport stick 100 when the sport stick 100 is in the assembled configuration.

This particular embodiment of shaft connector 508C allows the user to have a high degree of control of the shaft strength and shaft flexibility characteristics of an assembled sport stick 100. For example, if the user prefers to have a stronger and/or less flexibly upper portion of the assembled shaft and a more flexible lower portion of the shaft for game play, the user may use the shaft connector 508C. Further, a plurality of different shaft connector 508C, each with different predefined proximal body lengths D3 and predefined distal body lengths D4, may be provided so that the user may selectively define the shaft strength and shaft flexibility characteristics of their assembled sport stick 100. Further, the user could flip shaft connector 508C around (reverse the longitudinal orientation) to further control shaft strength and/or shaft flexibility.

In practice, a plurality of different shaft connectors, such as the example shaft connectors 508A, 508B, 508C, may be provided so that when a sport stick 100 is assembled using a plurality of different selected shaft connectors 508A, 508B, 508C, the shaft strength and/or shaft flexibility can be controlled to an intended and/or predefined characteristic. For a particular shaft section with known characteristics (unique strength and/or flex characteristics), a selected one of the plurality of shaft connectors (with a unique known shaft strength characteristic and/or a unique shaft flexibility characteristic) may be used to secure shaft sections together so that the assembled sport stick 100 provides a desired shaft strength and/or shaft flexibility along the length of the shaft. Here, unique characteristics of a selected shaft connector 508A, 508B, 508C (each with a unique body length D2, proximal body length D3, and distal body length D4) will control shaft strength and/or shaft flexibility of the assembled sport stick 100.

Figure 10A:
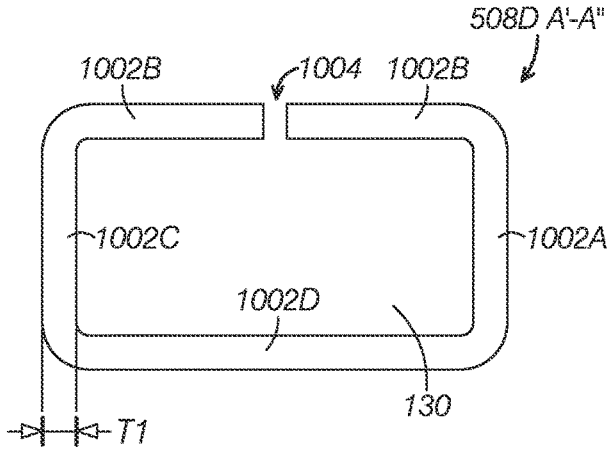
FIG. 10A is a cross sectional view of an example shaft connector embodiment with a predefined thickness dimension.
Figure 10B:
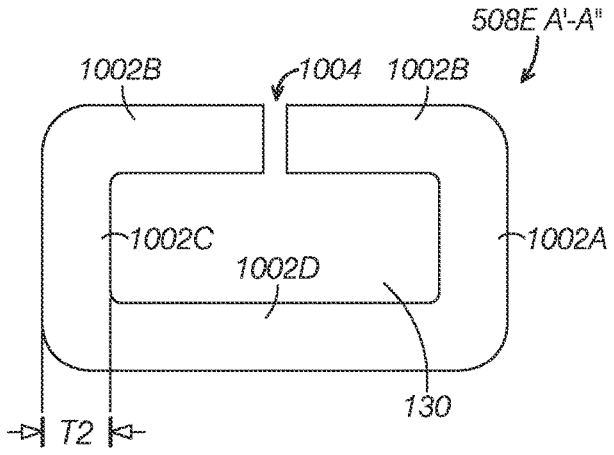
FIG. 10B is a cross sectional view of another example shaft connector that has a different predefined thickness dimension than the shaft connector embodiment illustrated in FIG. 10A.

FIG. 10A is cross sectional view an example shaft connector 508D embodiment with a first predefined thickness dimension T1 for its walls 1002A-D. FIG. 10B is a cross sectional view of another example shaft connector 508E that has a different predefined thickness dimension T2 than the shaft connector 508D embodiment illustrated in FIG. 10A. Here, the predefined thickness of the walls 1002A-D of the shaft connectors 508D, 508E will determine the degree of shaft strength and/or shaft flexibility control provided by that particular shaft connector. The particular amount of shaft strength and/or shaft flexibility control provided by a shaft connector can be determined based known dimensions of the shaft connector, or may be measured. The predefined thickness of the walls 1002A-D are defined during a fabrication process and/or during engineering design.

Furthermore, each of the walls 1002A-D of a shaft connector embodiment may have a unique predefined thickness. For example, but not limited to, the thickness of walls 1002A and 1002C may be greater than (or less than) the thickness of walls 1002B and 1002D. As yet another example, the thickness of wall 1002D may be thicker than walls 1002A-C to provide a different shaft strength and/or shaft flexibility characteristic to a particular side of the assembled shaft 100, such as the back side or the front side of the shaft 100.

In some embodiments, a slot 1004 may be disposed along the longitudinal length of one of the walls 1004A-D. The width of the slot 1004 generally corresponds to the thickness of the elongate tension bearing member 128. Accordingly, during shaft assembly, the elongate tension bearing member 128 may be slid through the slot 1004 so that the shaft connector may be then used to secure two shaft sections together. In some embodiments, the wall 1002B might be omitted such that the three remaining walls of a shaft connector are used to control shaft strength and/or shaft flexibility. (In some embodiments, such as those embodiments that are pre-assembled at a factory, the elongate tension bearing member 128 can be threaded through the longitudinal bores 130 of the shaft sections and shaft connectors, and then connected as described herein to the shaft ends.)

Figure 11A:
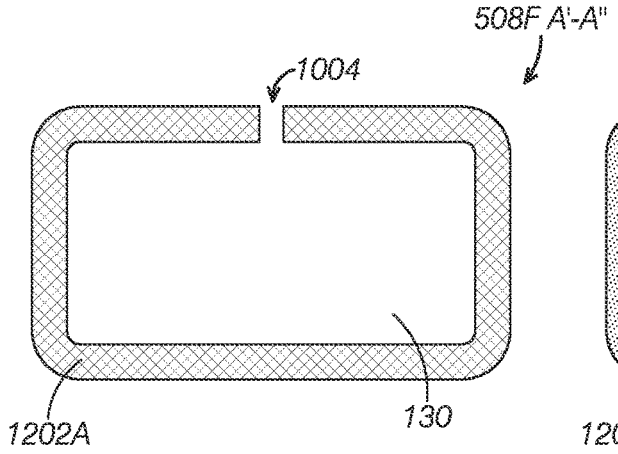
FIG. 11A is a cross sectional view of an example shaft connector embodiment made of a predefined material that provides at least one of a strength characteristic or a flex characteristic to the sport stick.
Figure 11B:
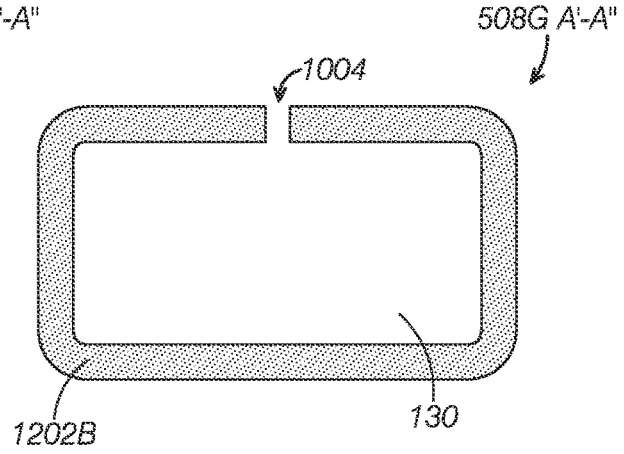
FIG. 11B is a cross sectional view of an example shaft connector embodiment made of a different predefined material that provides at least one of a strength characteristic or a flex characteristic to the sport stick that is different from the strength characteristic or the flex characteristic of the shaft connector embodiment illustrated in FIG. 11A.

FIG. 11A is a cross sectional view of an example shaft connector embodiment made of a predefined material 1202A that provides at least one of a known strength characteristic or a known flex characteristic to the sport stick shaft which may be determined or measured. FIG. 11B is a cross sectional view of an example shaft connector embodiment made of a different predefined material 1202B that provides at least one of a known strength characteristic or a known flex characteristic to the sport stick that is different from the strength characteristic or the flex characteristic of the shaft connector embodiment illustrated in FIG. 11A. The difference in the shaft strength and/or shaft flexibility arises from the unique characteristics of the particular material used to fabricate the shaft connector. The shaft strength and/or shaft flexibility characteristics of the known shaft connector material may be determined based on material characteristics and known dimensions of the shaft connector, or may be measured.

Figure 12A:
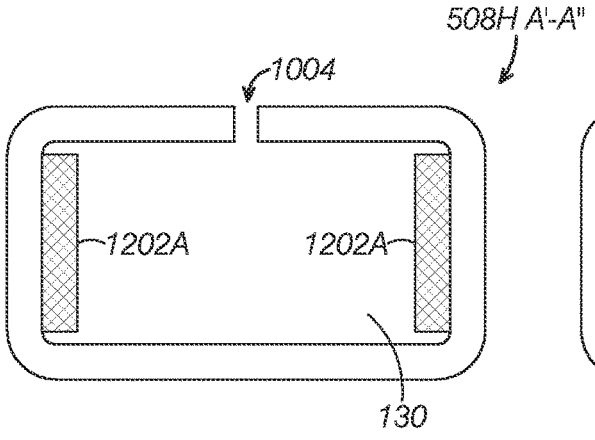
FIG. 12A is a cross sectional view of an example shaft connector embodiment with a predefined internal member made of a material that provides at least one of a strength characteristic or a flex characteristic to the sport stick.
Figure 12B:
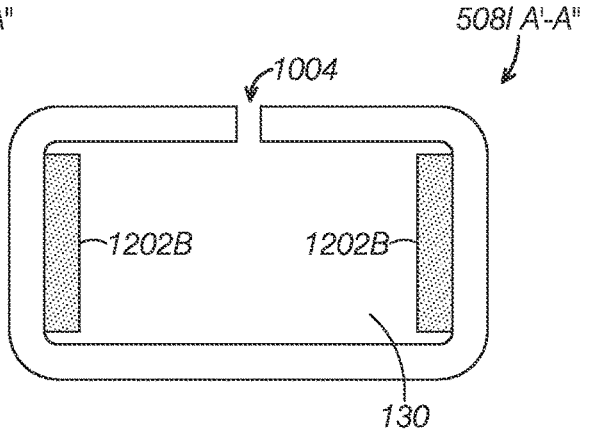
FIG. 12B a cross sectional view of is an example shaft connector embodiment with a predefined internal member made of a different material that provides at least one of a strength characteristic or a flex characteristic to the sport stick that is different from the strength characteristic or the flex characteristic of the shaft connector embodiment illustrated in FIG. 12A.

FIG. 12A is a cross sectional view of an example shaft connector 508H embodiment with an internal member 1202A made of a predefined material that provides at least one of a known strength characteristic or a known flex characteristic to the sport stick 100. FIG. 12B is a cross sectional view of an example shaft connector 508I embodiment with an internal member 1202B made of a different predefined material that provides at least one of a known unique strength characteristic or a known unique flex characteristic to the sport stick that is different from the strength characteristic or the flex characteristic of the shaft connector embodiment illustrated in FIG. 12A.

During fabrication of the shaft connector 508H, 508I, the internal member may be secured to the inside surface of one or more walls 1002A-C using a suitable securing means, such as a screw, bolt, snap, slot, adhesive or the like. In some embodiments, the internal member may be releasably secured to a wall. Accordingly, the user may change to different releasably secured internal members to control shaft strength and/or shaft flexibility. For example, internal members may have different dimensions (length, width, thickness) and/or may be made of different materials.

Figure 13:
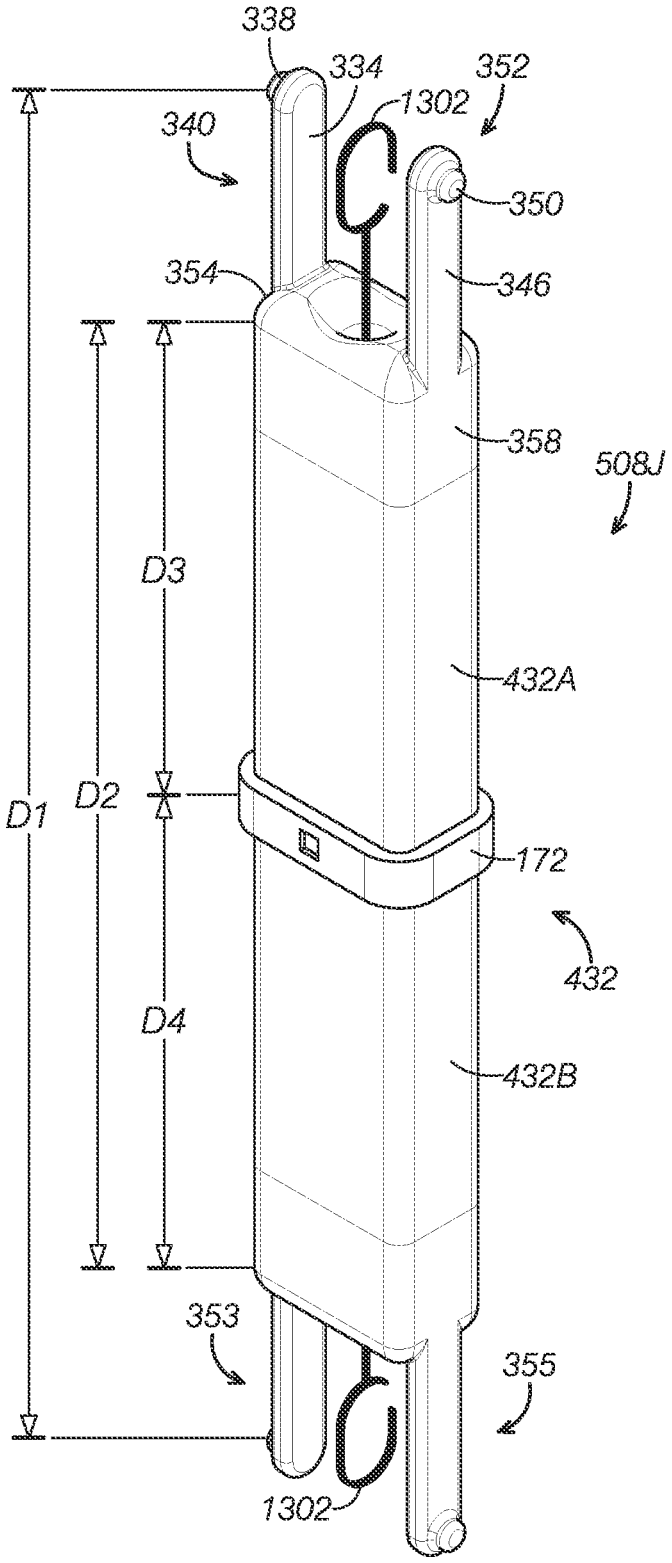
FIG. 13 is a cross sectional view of an example shaft connector that provides a securing means to secure an internal cord to the ends of the shaft connector.

FIG. 13 is an example shaft connector 508J that provides a securing means 1302 to secure an internal elongate tension bearing member 128 (not shown) to the ends of the shaft connector 508J. In some embodiments, the elongate tension bearing member 128 is provided as a plurality of elongate tension bearing member sections. The securing means 1302 is secured to an end of the elongate tension bearing member section which extends through the longitudinal bore 130 of the shaft section. The user may secure the securing means 1302 permanently to the elongate tension bearing member section during assembly of the sport stick 100. Alternatively, the user may releasably secure the securing means 1302 to the elongate tension bearing member section when the shaft connector 508J is being used to secure two adjacent shaft sections together. In embodiments that allow the user to release the end of the elongate tension bearing member section from the securing means 1302, the user may then reassemble the sport stick using a different shaft connector 508J (having different shaft strength and/or shaft flexibility characteristics).

A variety of different securing means 1302 may be used in the various shaft connector embodiments. As illustrated in FIG. 13, a metal hook or the like may be used to secure to a loop at the end of the elongate tension bearing member section. A latch, a snap, a tab, a button, a magnet, a fabric looping strap or the like may alternatively be used to secure the end of the elongate tension bearing member section. A threaded bolt/screw may be used to threadedly secure the shaft connector 508J to a threaded nut on the end of the elongate tension bearing member section (or vice versa).

Some embodiments of an assembled sport stick 100 may not employ a longitudinal bore 130 and the associated elongate tension bearing member 128. The shaft sections may have cavities at their proximal and distal ends that are large enough to receive the detents 340, 353 and the corresponding proximal body portion 432A and distal body portion 432B of the shaft connectors 508A-J. (Alternatively, a longitudinal bore 130 may extend through the shaft section.) In such embodiments, the shaft connector 508A-J may be a solid body member.

In some embodiments, the shaft connectors A-J may be a two-piece shaft connector comprising a predefined proximal connector member and a predefined distal connection member. One two members are coupled together, one member may be the proximal member of the shaft connector and the second member may be the distal member of the shaft connector. The proximal connector member and the distal member may be secured to together before use using any suitable securing means described herein. In some systems, a variety of different connector members may be provided to the user who may then select a proximal connector member and a distal connector member of interest that will be secured together before use. Each different connector member may have different predefined characteristics (a different body length D2, proximal body length D3, distal body length D4, material, wall thickness, etc.)

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A sport stick system for a sport stick that is configured to selectively convert between an assembled configuration and a disassembled configuration, comprising:

a first shaft section defined by a first proximal shaft section end and a first distal shaft section end, wherein the first shaft section includes a first hole disposed through a wall of the first shaft section proximate to the first distal shaft section end;

a second shaft section defined by a second proximal shaft section end and a second distal shaft section end, wherein the second shaft section includes a second hole disposed through a wall of the second shaft section proximate to the second proximal shaft section end; and a plurality of shaft connectors each configured to couple the first distal shaft section end of the first shaft section to the second proximal shaft section end of the second shaft section, wherein each one of the plurality of shaft connectors comprise:

a body defined by a proximal body end located at a proximal end of the body and a distal body end located at a distal end of the body, wherein a predefined body length defines a length of the body;

a first detent extending from the proximal body end of the body, the first detent comprising a first projection that is configured to engage the first hole of the first shaft section; and a second detent extending from the distal body end of the body, the second detent comprising a second projection that is configured to engage the second hole of the second shaft section, wherein in the assembled configuration, the first section, the first shaft connector, and the second section are coupled together, wherein in the disassembled configuration, one or more of the first section, the first shaft connector, and the second section are selectively decoupled, wherein a total shaft connector length is defined by a distance from the first projection of the first detent to the second projection of the second detent, and wherein the total shaft connector length is the same for each of the plurality of shaft connectors, and wherein the predefined body length of a first one of the plurality of shaft connectors is different from the predefined body length of a second one of the plurality of shaft connectors.

2. The sport stick system of claim 1, wherein the predefined body length of the body of each one of the plurality of shaft connectors defines at least one of a unique strength characteristic of the sport stick and a unique flexibility characteristic of the sport stick when the sport stick is in the assembled configuration.

3. The sport stick system of claim 2, wherein a first unique strength characteristic of the sport stick when assembled with the first one of the plurality of shaft connectors is defined by the first predefined body length, wherein a second unique strength characteristic of the sport stick when assembled with the second one of the plurality of shaft connectors is defined by the second predefined body length, and wherein the first unique strength characteristic associated with the first one of the plurality of shaft connectors is different from the second unique strength characteristic associated with the second one of the plurality of shaft connectors because the predefined body length the first one of the plurality of shaft connectors is different from the predefined body length of the second one of the plurality of shaft connectors.

4. The sport stick system of claim 2, wherein a first unique flexibility characteristic of the sport stick when assembled with the first one of the plurality of shaft connectors is defined by the first predefined body length, wherein a second unique flexibility characteristic of the sport stick when assembled with the second one of the plurality of shaft connectors is defined by the second predefined body length, and wherein the first unique flexibility characteristic associated with the first one of the plurality of shaft connectors is different from the second unique flexibility characteristic associated with the second one of the plurality of shaft connectors because the predefined body length the first one of the plurality of shaft connectors is different from the predefined body length of the second one of the plurality of shaft connectors.

5. The sport stick system of claim 2, wherein the body of each one of the plurality of shaft connectors is further defined by a proximal body portion and a distal body portion, wherein the proximal body portion is defined by a predefined proximal body length, wherein the distal body portion is defined by a predefined distal body length, wherein the predefined proximal body length is different from the predefined distal body length, and wherein the predefined proximal body length and the predefined distal body length of each one of the plurality of shaft connectors cooperatively define at least one of the unique strength characteristic of the sport stick and the unique flexibility characteristic of the sport stick when the sport stick is in the assembled configuration.

6. The sport stick system of claim 1, wherein the first section, the first connector, and the second section each define a longitudinal bore, wherein the longitudinal bore extends through the first section, the first connector, and the second section when the sport stick is in the assembled condition, the sport stick system further comprising:

an elongate tension bearing member defined by a proximal end, a distal end, and a middle section, wherein the middle section of the elongate tension bearing member extends through the longitudinal bores of the first section, the first connector, and the second section to maintain the first section, the first connector, and the second section in proximity to each other while the sport stick is in the disassembled configuration.

7. The sport stick system of claim 6, wherein the shaft connector of each one of the plurality of shaft connectors includes a slot disposed along a longitudinal length a wall of the shaft connector, wherein a width of the slot corresponds to a thickness of the elongate tension bearing member, and wherein during assembly of the sport stick, the elongate tension bearing member is slid through the slot of the shaft connector.

8. The sport stick system of claim 1, wherein the shaft connector of each one of the plurality of shaft connectors is made of a different material, and wherein at least one of a unique strength characteristic of the sport stick and a unique flexibility characteristic of the sport stick when the sport stick is in the assembled configuration is defined by a characteristic of the material.

9. The sport stick system of claim 1, wherein the shaft connector of each one of the plurality of shaft connectors is defined by a plurality of walls, wherein the plurality of walls of each one of the plurality of shaft connectors have a predefined thickness dimension, wherein the predefined thickness dimension of each one of the plurality of shaft connectors is different, and wherein at least one of a unique strength characteristic of the sport stick and a unique flexibility characteristic of the sport stick when the sport stick is in the assembled configuration is defined by the predefined thickness dimension.

10. The sport stick system of claim 1, wherein the shaft connector of each one of the plurality of shaft connectors includes at least one internal member made of a predefined material, wherein the predefined material of the internal member in each one of the plurality of shaft connectors is different, and wherein at least one of a unique strength characteristic of the sport stick and a unique flexibility characteristic of the sport stick when the sport stick is in the assembled configuration is defined by a characteristic of the predefined material of the internal member.

11. The sport stick system of claim 1, wherein the body of the shaft connector of each one of the plurality of shaft connectors is solid, wherein the distal end of the first shaft section includes a first cavity that is at least large enough to receive the proximal detent and a proximal body portion of the body of each of the plurality of shaft connectors, and wherein the proximal end of the second shaft section includes a second cavity that is large enough to receive the distal detent and a distal body portion of the body of each of the plurality of shaft connectors.

12. A plurality of shaft connectors for a sport stick that is configured to selectively convert between an assembled configuration and a disassembled configuration, wherein the sport stick includes at least a first shaft section defined by a first proximal shaft section end and a first distal shaft section end, wherein the first shaft section includes a first hole disposed through a wall of the first shaft section proximate to the first distal shaft section end, wherein the sport stick includes at least a second shaft section defined by a second proximal shaft section end and a second distal shaft section end, wherein the second shaft section includes a second hole disposed through a wall of the second shaft section proximate to the second proximal shaft section end, each of the plurality of shaft connectors comprising:

a body defined by a proximal body end located at a proximal end of the body and a distal body end located at a distal end of the body, wherein a predefined body length defines a length of the body;

a first detent extending from the proximal body end of the body, the first detent comprising a first projection that is configured to engage the first hole of the first shaft section; and a second detent extending from the distal body end of the body, the second detent comprising a second projection that is configured to engage the second hole of the second shaft section, wherein each one of the plurality of shaft connectors are configured to couple the first distal shaft section end of the first shaft section to the second proximal shaft section end of the second shaft section in response to the first projection engaging the first hole of the first shaft section and in response to the second projection engaging the second hole of the second shaft section, wherein a total shaft connector length is defined by a distance from the first projection of the first detent to the second projection of the second detent, wherein the total shaft connector length is the same for each of the plurality of shaft connectors, and wherein the predefined body length of each one of the plurality of shaft connectors is different.

13. The plurality of shaft connectors of claim 12, wherein the predefined body length of the body of each one of the plurality of shaft connectors defines at least one of a unique strength characteristic of the sport stick and a unique flexibility characteristic of the sport stick when the sport stick is in the assembled configuration.

14. The plurality of shaft connectors of claim 13, wherein a first unique strength characteristic of the sport stick when assembled with a first one of the plurality of shaft connectors is defined by a first predefined body length of the first one of the plurality of shaft connectors, wherein a second unique strength characteristic of the sport stick when assembled with a second one of the plurality of shaft connectors is defined by a second predefined body length of the second one of the plurality of shaft connectors, and wherein the first unique strength characteristic associated with the first one of the plurality of shaft connectors is different from the second unique strength characteristic associated with the second one of the plurality of shaft connectors because the predefined body length the first one of the plurality of shaft connectors is different from the predefined body length of the second one of the plurality of shaft connectors.

15. The plurality of shaft connectors of claim 13, wherein a first unique flexibility characteristic of the sport stick when assembled with a first one of the plurality of shaft connectors is defined by a first predefined body length of the first one of the plurality of shaft connectors, wherein a second unique flexibility characteristic of the sport stick when assembled with a second one of the plurality of shaft connectors is defined by a second predefined body length of the second one of the plurality of shaft connectors, and wherein the first unique flexibility characteristic associated with the first one of the plurality of shaft connectors is different from the second unique flexibility characteristic associated with the second one of the plurality of shaft connectors because the predefined body length the first one of the plurality of shaft connectors is different from the predefined body length of the second one of the plurality of shaft connectors.

16. The plurality of shaft connectors of claim 13, wherein the body of each one of the plurality of shaft connectors is further defined by a proximal body portion and a distal body portion, wherein the proximal body portion is defined by a predefined proximal body length, wherein the distal body portion is defined by a predefined distal body length, wherein the predefined proximal body length is different from the predefined distal body length, and wherein the predefined proximal body length and the predefined distal body length of each one of the plurality of shaft connectors cooperatively define at least one of the unique strength characteristic of the sport stick and the unique flexibility characteristic of the sport stick when the sport stick is in the assembled configuration.

17. The plurality of shaft connectors of claim 12, wherein the shaft connector of each one of the plurality of shaft connectors is made of a different material, and wherein at least one of a unique strength characteristic of the sport stick and a unique flexibility characteristic of the sport stick when the sport stick is in the assembled configuration is defined by a characteristic of the material.

18. The plurality of shaft connectors of claim 12, wherein the shaft connector of each one of the plurality of shaft connectors is defined by a plurality of walls, wherein the plurality of walls of each one of the plurality of shaft connectors have a predefined thickness dimension, wherein the predefined thickness dimension of each one of the plurality of shaft connectors is different, and wherein at least one of a unique strength characteristic of the sport stick and a unique flexibility characteristic of the sport stick when the sport stick is in the assembled configuration is defined by the predefined thickness dimension.

19. The plurality of shaft connectors of claim 12, wherein the shaft connector of each one of the plurality of shaft connectors includes at least one internal member made of a predefined material, wherein the predefined material of the internal member in each one of the plurality of shaft connectors is different, and wherein at least one of a unique strength characteristic of the sport stick and a unique flexibility characteristic of the sport stick when the sport stick is in the assembled configuration is defined by a characteristic of the predefined material of the internal member.

20. The plurality of shaft connectors of claim 12, wherein the body of the shaft connector of each one of the plurality of shaft connectors is solid, wherein the distal end of the first shaft section includes a first cavity that is at least large enough to receive the proximal detent and a proximal body portion of the body of each of the plurality of shaft connectors, and wherein the proximal end of the second shaft section includes a second cavity that is large enough to receive the distal detent and a distal body portion of the body of each of the plurality of shaft connectors.

* * * * *